US005679036A

United States Patent [19]

Crawley

[11] Patent Number: 5,679,036

[45] Date of Patent: Oct. 21, 1997

[54] REVERSIBLE MOTOR MOUNT FOR CANOE

[76] Inventor: James Phillip Crawley, 22 Ponemah Hill Rd., Amherst, N.H. 03031

[21] Appl. No.: 762,384

[22] Filed: Dec. 7, 1996

[51] Int. Cl.[6] ..... B63H 5/125

[52] U.S. Cl. ..... 440/53; 114/347; 114/363; 440/113; 440/642

[58] Field of Search ..... 114/343, 364; 440/53, 113, 900; 248/640–643

[56] References Cited

U.S. PATENT DOCUMENTS

| | | | |
|---|---|---|---|
| 4,382,574 | 5/1983 | Ellestad | 248/641 |
| 4,616,591 | 10/1986 | Minor | 114/347 |
| 5,005,798 | 4/1991 | McCoy | 248/642 |
| 5,137,249 | 8/1992 | Royster | 248/642 |

*Primary Examiner*—Jesus D. Sotelo

*Attorney, Agent, or Firm*—Joseph E. Funk

[57] ABSTRACT

A reversible motor mount that can be attached to the gunnel on either side of a canoe is disclosed. The mount has a movable piece with a bracket to which said motor is clamped. The movable piece is locked in a first position when the motor mount is mounted on one side of the canoe and is locked in a second position when the motor mount is mounted on the other side of the canoe. No matter which side of the canoe said mount is attached to, and the movable piece is moved and locked in the appropriate position, and said motor is clamped to said bracket, the propulsion force from said motor when it is in operation will be downward and rearward.

3 Claims, 3 Drawing Sheets

REVERSIBLE MOTOR MOUNT FOR CANOE

FIELD OF THE INVENTION

This invention relates to motor mounts for boats, and more particularly to motor mounts that attach to the side of canoes.

BACKGROUND OF THE INVENTION

In the prior art motor mounts have been developed that attach to the left or right side of a canoe. However, those motor mounts utilize a bar that spans across the canoe and attaches to the edge of both sides of the canoe. This bar interferes with a person sitting in the canoe adjacent to the motor attached to motor mount. All other mounts are designed to attach to one side or the other side of a canoe but they cannot be changed from one side of the canoe to the other side. Therefore, to provide motor mounts for both sides of a canoe, two versions of the motor mount had to be designed. This required additional manufacturing steps and more distributor and retailer inventory. This inevitably resulted in motor mounts costing more.

Thus, there is a need in the prior art for a canoe motor mount that is reversible and can easily and quickly be attached to either side of a canoe. Such a reversible canoe motor mount will simplify manufacturing operations and will require that distributors and retailers only stock one motor mount to meet both requirements.

This need in the prior art is met by my novel, reversible canoe motor mount. It may quickly and easily be moved from one side of a canoe to the other side, and with one other minor adjustment be ready to mount a motor on the opposite side of a canoe.

DESCRIPTION OF THE DRAWING

My invention will be better understood on reading the following detailed description in conjunction with the drawing in which.

DETAILED DESCRIPTION

Figure 1:
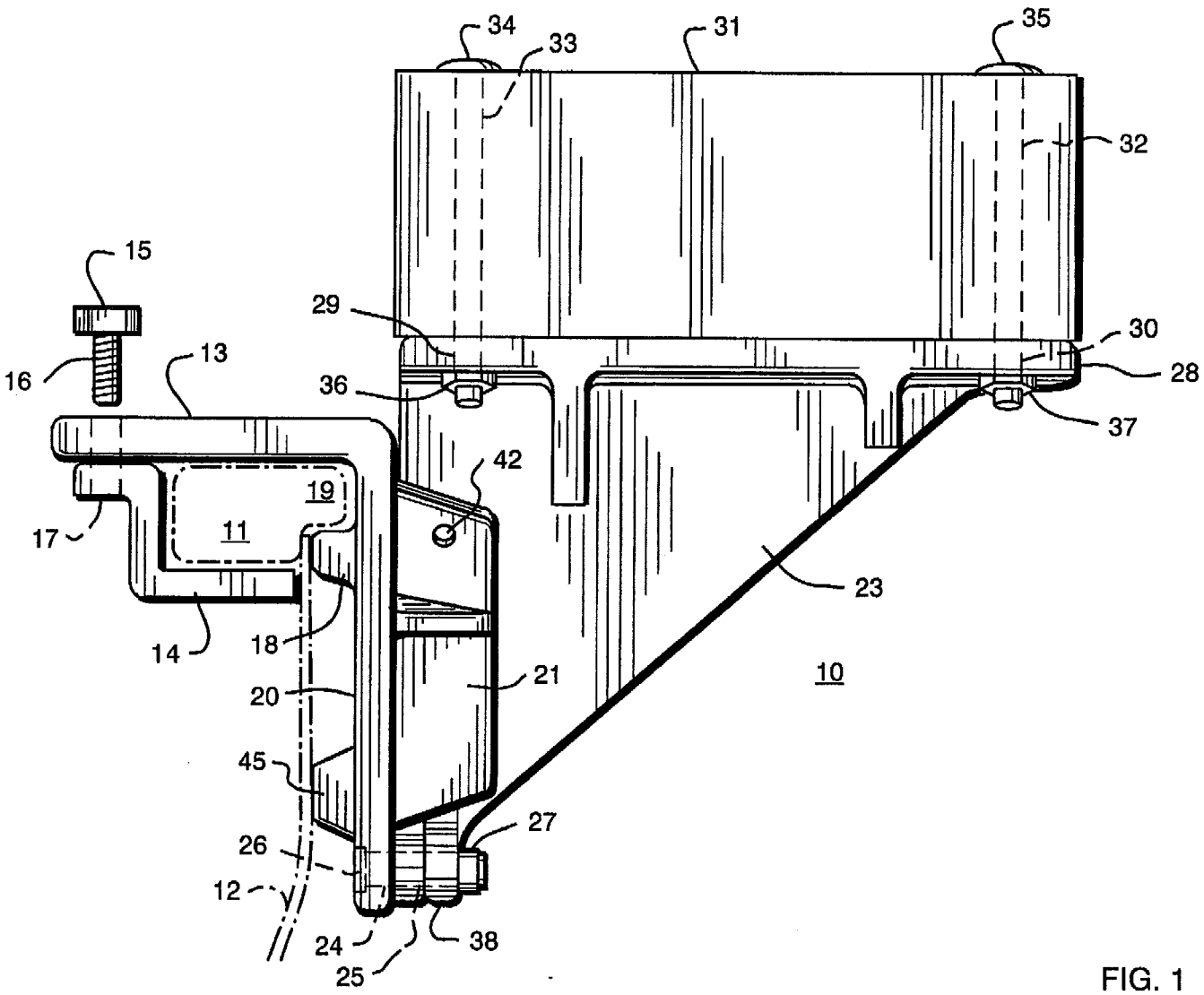
FIG. 1 is an end view of the gunnel of a canoe to which my novel motor mount is attached.

In FIG. 1 is seen an end view, parallel with the main axis of a canoe showing my novel motor mount attached to the side of a canoe. Details of the canoe are not shown except for the gunnel 11 and the wall 12 of the canoe. Gunnel 11 is typically attached to the top of wall 12 by rivets or other means, not shown, and extends around the top periphery of the canoe as is well known in the art. Gunnel 11 protects the top edge of canoe wall 12 and stiffens it, while protecting those using the canoe from getting cut on the top edge of the canoe wall. Gunnel 11 may be made from extruded aluminum or plastic and may be hollow or solid.

The motor mount comprises a main body having most of the elements shown on the right side of FIG. 1. The main body has a top piece 13, a hook piece 18 and a clamp piece 14. With most of the motor mount hanging on the outside of the canoe, when mounted top piece 13 sits on top of gunnel 11 with hook piece 18 extending under the portion 19 of gunnel 11 which extends over the top of canoe wall 12, as shown. Top piece 13 has a hole 16 drilled therethrough, and clamp piece 14 has a hole 17 drilled therethrough. Hole 17 is tapped to accept the threads of a bolt 15 in a locking engagement. With the top piece 13 of the motor mount astride the top of gunnel 11 and clamp piece 14 in the position shown, bolt 15 is inserted through hole 16 and is screwed into the threads of hole 17 until gunnel 11 is clamped tightly between top piece 13 and clamp piece 14.

While it is not clear in FIG. 1 which side of the canoe my novel motor mount is mounted on, the motor mount can be mounted on either side of the canoe to accommodate people who are right or left handed as will be clearer when reading further in this description in conjunction with the other figures.

My motor mount has a vertical piece 20 that extends roughly vertical to the water, and it has a first boss 21 (shown) and a second boss 22 which is not shown in FIG. 1, but is seen in the other figures, that extend perpendicularly from vertical piece 20. As will be better seen in FIG. 2, bosses 21 and 22 are each straight but are oriented at an angle of thirty degrees with respect to each other and being closest to each other near bolt 26.

There is also a movable arm 23 which is pivotally attached to the bottom of vertical piece 20 as shown. There is a hole 24 with a recessed area through vertical piece 20, and there is a hole 25 through the bottom of movable arm 23. Holes 24 and 25 are coaxial with each other. To attach movable arm 23 to vertical piece 20 a screw 26 is inserted through holes 24 and 25 from the side of vertical piece 20 that is nearest to canoe wall 12. The head of screw 26 is in the recessed area of hole 24. The threaded end of screw 26 extends beyond the surface of movable arm 23 and a nut 27 is turned thereon to tightly hold movable arm 23 against vertical piece 20 with arm 23 located between bosses 21 and 22. As will be better seen in FIG. 2, movable arm 23 rest against either boss 21 or 22 depending on which side of the canoe the motor mount is mounted on.

When the motor mount is moved from one side of the canoe to the other side, nut 27 is loosened, movable arm 23 is swung from against one of bosses 21 and 22 to against the other boss and nut 27 is re-tightened.

At the top of movable piece 23, and integral therewith, is an arm 28 which is perpendicular to the surface of movable piece 23. Arm 28 has two holes 29 and 30 drilled therethrough. There is also a block of wood 31 which has a rectangular cross section, that is seen better in FIG. 2, and is in the order of six to eight inches long. Block of wood 31 has cross sectional dimensions of one inch by three inches, and the three inch dimension is the height of the block seen in FIG. 1. Block of wood 31 also has two holes 32 and 33 drilled therethrough across its three inch height. Wood block 28 is fastened to arm 28 by coaxially aligning hole 32 to hole 30 and hole 33 to hole 29. A toggle bolt 35 is then inserted through holes 32 and 30, and a nut 37 is tightly screwed onto the exposed threaded end of bolt 35. Similarly, toggle bolt 34 is inserted through holes 33 and 29, and a nut 36 is tightly screwed onto the exposed threaded end of bolt 34.

To mount a motor to my novel motor mount, the clamp of the motor, not shown, is placed over wood block 31 and its clamp tightened in a manner well known in the art.

Figure 2:
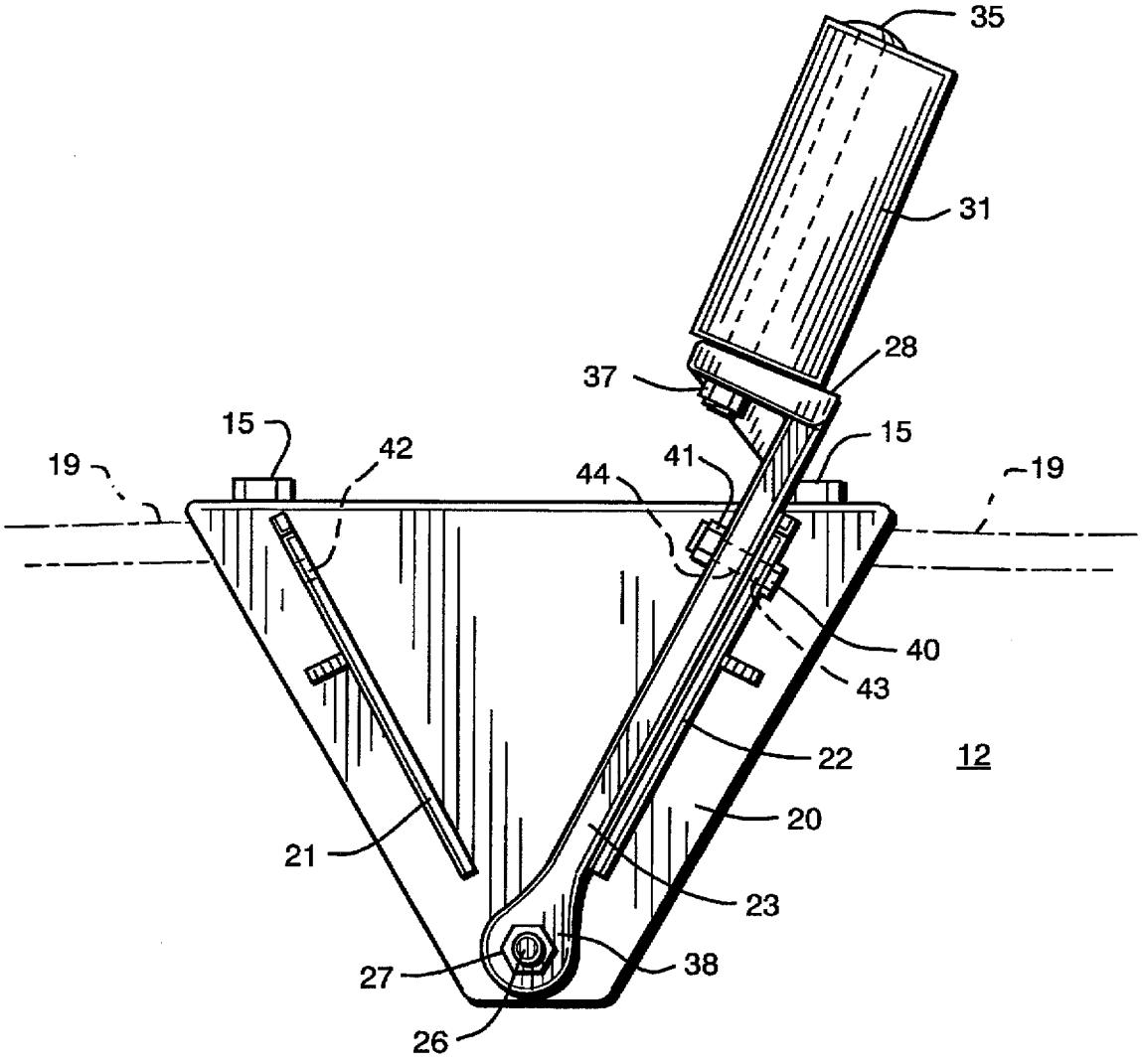
FIG. 2 is a view of the motor mount attached to the side of a canoe as seen from the outside of the canoe.

In FIG. 2 is a view of the motor mount attached to the side of a canoe as seen from the outside of the canoe. The side wall of the canoe is 12, and at the top of the wall is seen portion 19 of gunnel 11 that extends over the top of the wall 12 of the canoe. It can be seen vertical piece 20 of the motor mount has a triangular shape and bosses 21 and 22 are perpendicular to it. Bosses 21 and 22 are each at an approximate angle of fifteen degrees from the vertical. Movable arm 23 is shown positioned against boss 22 and is held there by tightening bolt 27 and by using bolt 40. There is a hole 42 through boss 21 and another hole 43 through boss 22. There is also a hole 44 through movable arm 23. When arm 23 is positioned to the right hole 44 is coaxially aligned with hole 43, and when arm 23 is swung over to the left and positioned against boss 21, when the motor mount is to be mounted on the opposite side of the canoe, hole 44 is coaxially aligned with hole 42. Whichever position movable arm is in bolt 40 is inserted through the coaxially aligned holes and nut 41 is tightly screwed onto the exposed threads of bolt 40.

Wooden block 31 is shown fastened onto the top of arm 28 with its narrow cross sectional dimension. As previously described a motor, not shown, is clamped onto wooden block 31.

No matter to which side of the canoe the motor mount is attached, movable arm 23 is moved to the position where it rests against the boss 21 or 22 that is closest to the rear of the canoe and is locked in that position by bolt 40 and nut 41. The motor, not shown, is then clamped to wood block 31 so the propeller of the motor faces the rear of the canoe. When mounted in this position the angular position of movable arm 23, which is approximately fifteen degrees off vertical causes the propulsion force from the motor to be directed rearward and approximately fifteen degrees downward. This yields the best propulsion force for the canoe.

Figure 3:
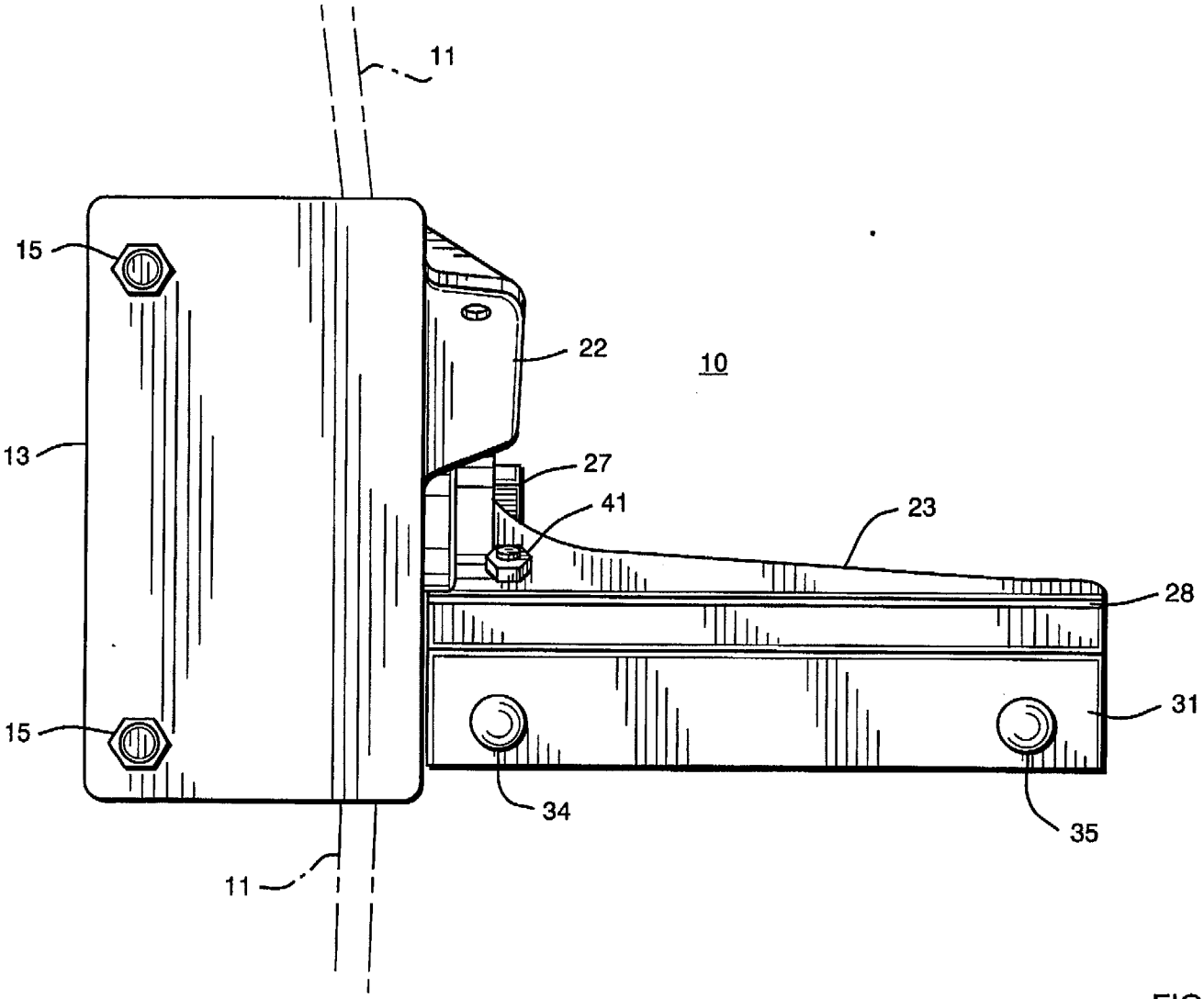
FIG. 3 is a top view of the motor mount attached to the side of a canoe.

In FIG. 3 is seen a top view of my novel motor mount. The top piece 13 of the motor mount sits on top of gunnel 11 and the bolts 15 clamp it to clamp piece 14 (not seen in FIG. 3) to tightly clamp the motor mount to gunnel 11. In this top view movable arm is shown swung to its rearward position and locked there by bolt 41 against boss 21 which is not seen in this view. Boss 22 can be seen. When the motor is clamped to wood block 31 and the motor is run, its propulsion force is rearward and downward by approximately fifteen degrees.

What is claimed is:

1. A mount for attaching a motor to the gunnel of a canoe that has a front and a rear and a that has a first side and a second side, said motor mount comprising:

a first part that mounts on the outside of said canoe;

means for tightly clamping said first part to said gunnel on either said first side or said second side of said canoe;

a second part movably attached to said first part and to which said motor is mounted, said second part being moved to a first position when said motor mount is clamped to said first side of said canoe, and said second part being moved to a second position when said motor mount is clamped to said second side of said canoe, and when said motor mount is attached to said first side of said canoe said motor is attached to said second part in a first orientation, and when said motor mount is attached to said second side of said canoe said motor is attached to said second part in a second orientation that is reversed from said first orientation; and when said motor mount is on said first side of said canoe and said second part is in said first side position with said motor clamped thereto in said first orientation the drive force from said motor is directed downward and toward the rear of said canoe, and when said motor mount is on said second side of said canoe and said second part is in said second position with said motor clamped thereto in said second orientation the drive force from said motor is directed downward and toward the rear of said canoe.

2. The mount for attaching a motor to the gunnel of a canoe in accordance with claim 1 further comprising means for locking said second part in said first position when said motor mount is mounted on said first side of said canoe, and locking said second part in said second position when said motor mount is mounted on said second side of said canoe.

3. The mount for attaching a motor to the gunnel of a canoe in accordance with claim 1 wherein said means for tightly clamping said first part to said gunnel on either said first side or said second side of said canoe comprises a clamp that goes around said gunnel on the inside of said canoe and is screwed to said first part to tightly clamp said motor mount to said gunnel.

* * * * *